US006301938B1

(12) United States Patent
Takeuchi et al.

(10) Patent No.: US 6,301,938 B1
(45) Date of Patent: Oct. 16, 2001

(54) AUTOMATIC FABRIC DENSITY ADJUSTING DEVICE AND YARN FEEDING CONTROL MECHANISM FOR A CIRCULAR KNITTING MACHINE

(75) Inventors: Shunji Takeuchi; Kyoya Kitagawa; Kozo Taniguchi, all of Kobe; Yasuo Nakamura, Osaka; Yoji Kawase; Hiromasa Nagai, both of Akashi, all of (JP)

(73) Assignee: Precision Fukuhara works, Ltd., Hyogo (JP)

( * ) Notice: Subject to any disclaimer, the term of this patent is extended or adjusted under 35 U.S.C. 154(b) by 0 days.

(21) Appl. No.: 09/667,340

(22) Filed: Sep. 22, 2000

(30) Foreign Application Priority Data

Sep. 24, 1999 (JP) ..... 11-269896
Aug. 25, 2000 (JP) ..... 13-255245

(51) Int. Cl.[7] ..... D04B 15/00
(52) U.S. Cl. ..... 66/54
(58) Field of Search ..... 66/55, 54, 56, 66/132 R, 131, 132 T

(56) References Cited

U.S. PATENT DOCUMENTS

| | | | | |
|---|---|---|---|---|
| 3,722,231 | | 3/1973 | Cooke . | |
| 4,194,375 | | 3/1980 | Marchisio . | |
| 5,172,569 | | 12/1992 | Schnurrer . | |
| 5,174,133 | | 12/1992 | Kawase et al. . | |
| 5,212,967 | * | 5/1993 | Shibata et al. | 66/27 |
| 5,275,020 | * | 1/1994 | Scherzinger et al. | 66/27 |
| 5,417,086 | | 5/1995 | Plath . | |
| 5,511,392 | | 4/1996 | Sawazaki et al. . | |
| 5,816,079 | | 10/1998 | Wang . | |
| 6,151,924 | | 11/2000 | Plath et al. . | |

FOREIGN PATENT DOCUMENTS

| | | | | |
|---|---|---|---|---|
| 32 32 643 | | 3/1984 | (DE) . | |
| 38 27 453 | | 10/1989 | (DE) . | |
| 39 31 997 | | 4/1991 | (DE) . | |
| 3431 743 | | 3/1996 | (DE) . | |
| 197 33 266 | | 2/1999 | (DE) . | |
| 1 504 674 | | 3/1978 | (GB) . | |
| 2156866 | * | 8/1986 | (GB) | 66/55 |
| 2170827 | * | 8/1986 | (GB) | 66/55 |
| 2193230 | * | 2/1988 | (GB) | 66/55 |
| 2099648 | | 4/1990 | (JP) . | |
| 9-171536 | | 6/1997 | (JP) . | |

* cited by examiner

*Primary Examiner*—Danny Worrell
(74) *Attorney, Agent, or Firm*—Alston & Bird LLP

(57) ABSTRACT

An automatic fabric-density adjusting device is provided and includes a detecting device for detecting the rotary movement of a knitting machine, a driving mechanism for driving a yarn positive feeding device in response to the signal detected by said detecting device, a controller for controlling the driving mechanism to cause said yarn feeding device to feed a requisite yarn volume for the desired fabric, a fabric tension sensor for detecting variations in the tension of the knit fabric and signaling the controller to vary the take-up of the fabric accordingly. An automatic yarn-feeding control device is also provided and comprises several knitting needles 53, a yarn-feeding device, which supplies knitting yarn to the knitting needles by a yam carrier, a cylinder, which houses the knitting needles in its needle groove, a cam holder, which faces the cylinder and is equipped with a control cam for controlling the knitting needles, and a cam ring, which supports the cam holder, and a yarn tension sensor for determining variations in tension and for signaling the controller to vary the knit stitch volume.

12 Claims, 12 Drawing Sheets

FABRIC SPECIFICATION

| KNITTING MACHINE DATA | | COLOR ARRANG. | COLOR | COUNT | MATERIAL |
|---|---|---|---|---|---|
| STRUCTURE | | 1 | BEIGE | 1/40 | COTTON |
| FEEDING VOLUME | 10.5 | 2 | BROWN | 1/40 | COTTON |
| FEEDING TENSION | 2 | 3 | WHITE | 75D | POLYESTER |
| DIAL HEIGHT | | | | | |
| SWITCHING AMOUNT | 0.6 | | | | |
| NEEDLE TIMING | | | | | |
| GATING | | | | | |
| SINKER TIMING | 2.5 | | | | |
| TAKE-UP VOLUME | 5.6 | | | | |

AUTOMATIC FABRIC DENSITY ADJUSTING DEVICE AND YARN FEEDING CONTROL MECHANISM FOR A CIRCULAR KNITTING MACHINE

FIELD OF THE INVENTION

The present invention relates to circular knitting machines and more particularly to an automatic fabric density adjusting device and yarn feeding control mechanism therefor.

BACKGROUND OF THE INVENTION

It is highly desirable in knit fabrics to have the stitch loops as uniform as possible. Various changeable conditions affect the size and volume of the stitch loops being formed on a circular knitting machine. Examples of such changeable conditions include the tension in the yarn being fed to the needles, the stroke of the needles and the speed of rotation of the cylinder.

One way to control the tension in the yarn and thus the stitch volume is to adjust the yarn-feeding speed. One such known device is disclosed in JP-B-3-72738 (1991). While somewhat effective, this device is complicated, complex in that it embodies many components and costly to manufacture. Therefore, it has not been found to be a solution to the problem.

Another approach to controlling stitch size and volume is to adjust the size of the stitch loops by raising and lowering the stitch cam support to vary the stroke of the needles during stitch formation. Examples of such stitch loop adjusting mechanisms are disclosed in U.S. Pat. Nos. 5,174,133 and 5,511,392. In both of these prior mechanisms, feeding characteristics of the yarn or yarns, such as yarn tension or quantity of yarn fed, are measured and the stitch cam height adjusted responsive to the differential in that measurement and a pre-set value. While more effective than previous attempts, these mechanisms relied primarily upon only one or two of the variables on changeable conditions affecting stitch size or volume and were therefore limited in their responsiveness and in the improvements in fabric quality they could achieve.

SUMMARY OF THE INVENTION

With the foregoing in mind, it is an object of the present invention to provide a circular knitting machine for forming knit stitch loops of more uniform size and volume and a fabric density adjusting system including an improved yam feeding mechanism for automatically adjusting the yarn feeding volume to the needles of a circular knitting machine, the stitch volume and the fabric take-up rate.

This object of the present invention is accomplished by providing an automatic yarn-feeding mechanism equipped with a detecting device for monitoring or detecting the rotary movement of the knitting machine and a driving means for driving the yam feeding mechanism in accordance with such rotary movement. Also, an automatic fabric density adjusting system incorporating this yarn feeding mechanism is provided. More particularly, the fabric density adjusting system includes a tension detector for sensing the tension in the yam being fed to the needles of the knitting machine, means for varying the stitch volume in accordance with the sensed variation in yam tension, means for detecting variations in fabric tension and means for adjusting the fabric take-up rate accordingly.

DETAILED DESCRIPTION OF THE INVENTION

Figure 1:
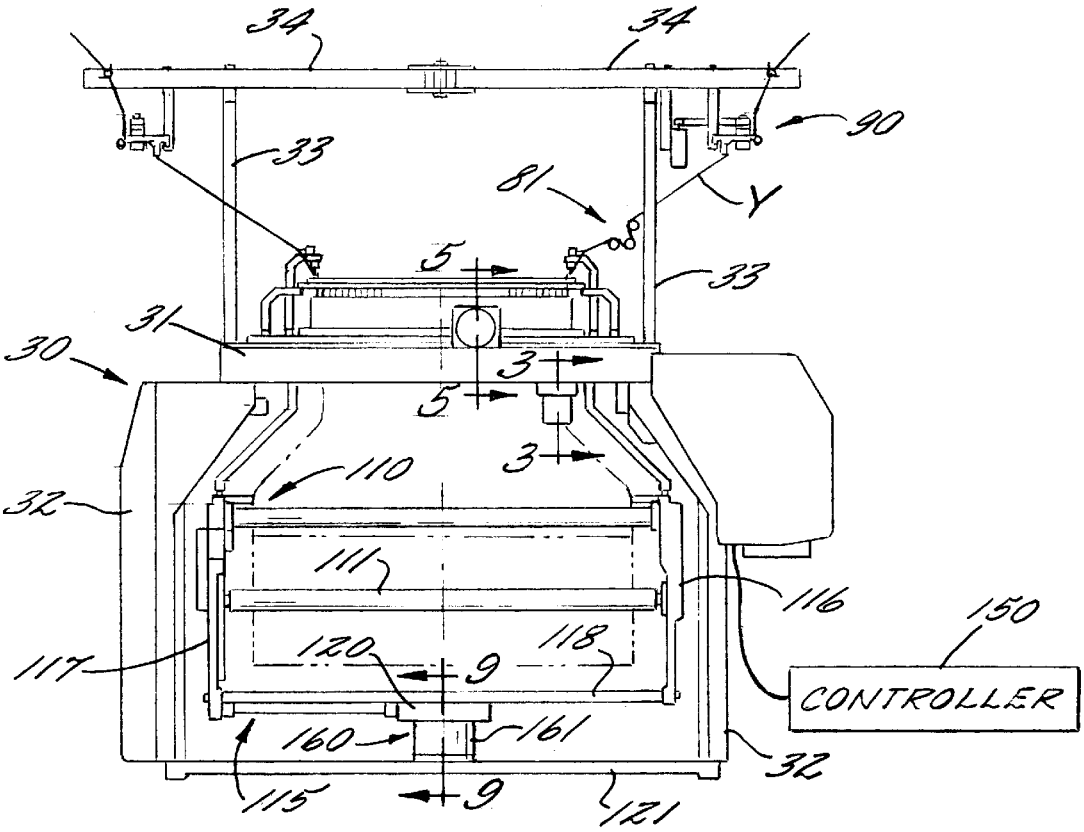
FIG. 1 is a front elevational view of a circular knitting machine embodying the present invention.
Figure 4:
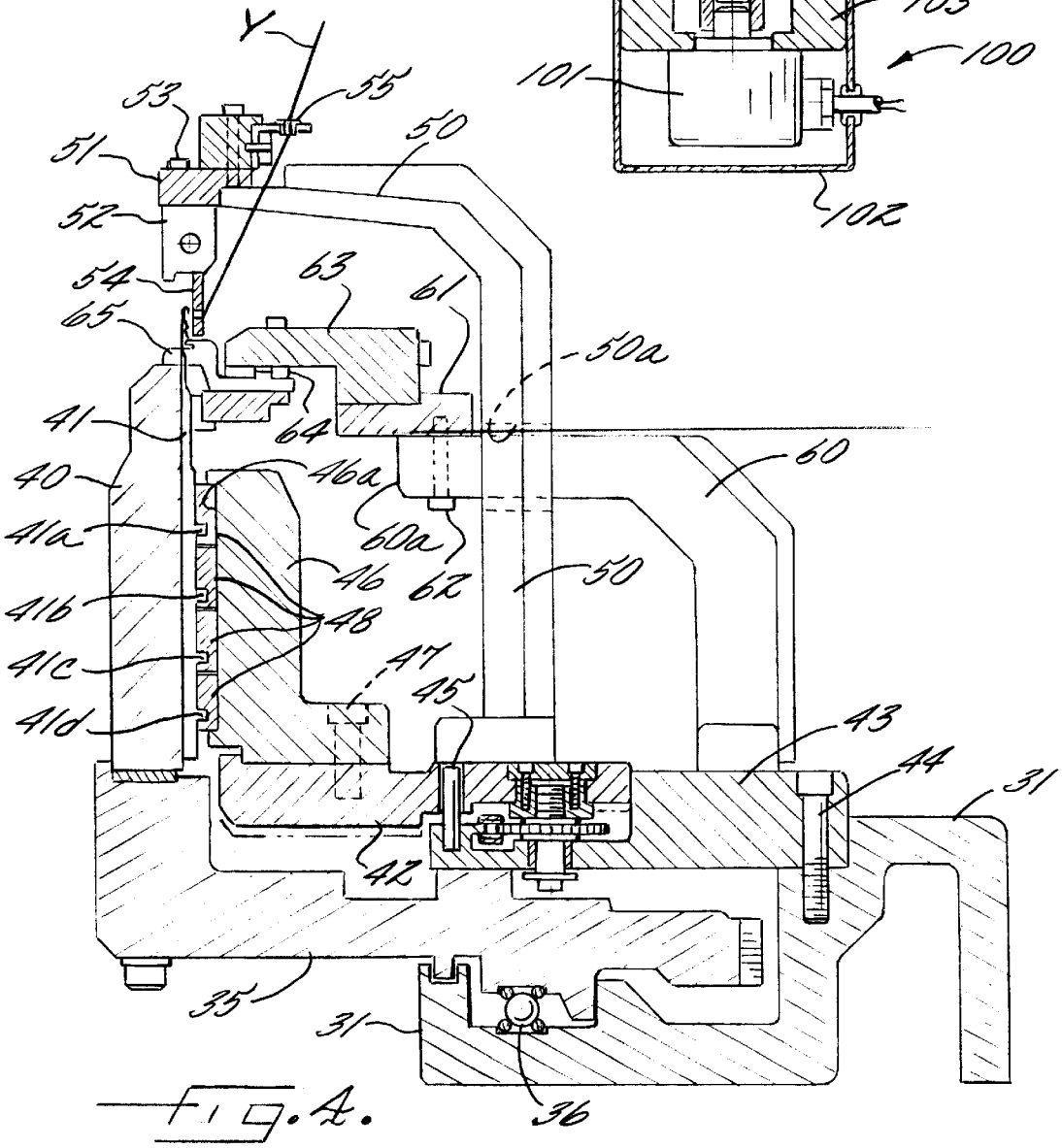
FIG. 4 is a sectional view showing the core portion of the knitting machine of FIG. 1.
Figure 5:
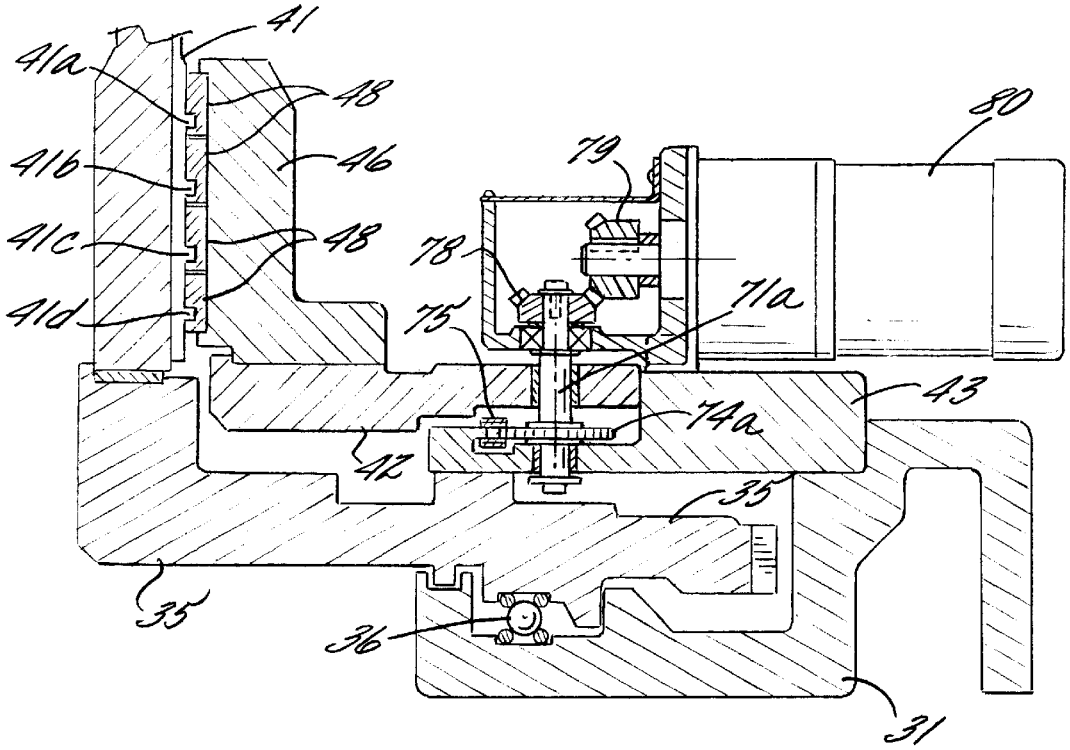
FIG. 5 is a sectional view taken substantially along line 5—5 in FIG. 1.

Referring now more particularly to the drawings and specifically to FIGS. 1, 4 and 5, there is illustrated a circular knitting machine, generally indicated at 30, which includes a bed 31 supported by a plurality of support members 32. Several posts 33 are mounted on bed 31 and extend upwardly therefrom and support horizontal members 34 thereon.

Knitting machine 30 further includes a main ring gear 35 rotatably mounted on bed 31 by a wire lace ball bearing 36

(FIGS. 4 and 5). Main ring gear 35 is driven in known manner by a suitable drive motor (not shown).

A needle cylinder 40 is carried by main ring gear 35 for rotation therewith and has a multiplicity of vertical needle grooves in its outer periphery. A cylinder needle 41 is mounted for vertical sliding movement in each of the needle grooves in the cylinder 40 and has a plurality of butts 41*a*, 41*b*, 41*c* and 41*d* thereon.

A cam ring 42 is positioned above bed 31 externally of but adjacent to the base of needle cylinder 40. A guide ring 43 is mounted on bed 31 by bolts 44 and underlies the outer portion of cam ring 42. A plurality of guide pins 45 (approximately six) links cam ring 42 with guide ring 43 while permitting vertical movement relative thereto.

A cam block or holder 46 is mounted on cam ring 42 by bolts 47 and has an inner vertical cam holding portion 46*a* facing the outer periphery of the needle cylinder 40. A plurality of needle operating cams 48 are supported by cam holding portion 46*a* of cam holder 46 for operating the needles 41 by respective cam tracks receiving and acting on the needle butts 41*a*–41*d* as the cylinder 40 rotates.

A plurality, preferably four to six, yam carrier supports 50 are carried by cam ring 42 at equal intervals and extend upwardly and inwardly to positions above the knitting needles 41. Each yarn carrier support 50 has a yam carrier ring 51 mounted thereon. Yam carrier ring 51 supports a holder 52 fastened thereto by a bolt 53. A yarn carrier 54 is mounted on and supported by the holder 52 and is supplied with a yarn Y through a guide 55 for delivery to the needles 41.

A plurality of cap ring supports 60 are mounted on guide ring 43 at equal intervals, the same as yarn carrier supports 50. Preferably, cap ring supports 60 penetrate through openings 50*a* through yam carrier supports 50 and terminate in inner ends 60*a*. A cap ring 61 is mounted on the inner ends 60*a* of cap ring supports 60 by bolts 62. A sinker cap 63 is mounted on cap ring 61 and supports sinker cams 64 for operating sinkers 65 in timed relation to the operation of the needles 41.

As previously described, cam ring 42 is mounted for vertical movement relative to guide ring 43 and thus relative to needle cylinder 40. Such vertical adjustment also adjusts the position or height of needle operating cams 48 which varies the stitch drawing stroke of the needles 41 and thus the stitch size and volume in the fabric being knit. Cam ring adjusting means, generally indicated at 70, is provided at each yarn feed station adjacent each yarn carrier support 50. Each cam ring adjusting means 70 includes a vertical shaft 71 rotatably mounted on guide ring 43. Shaft 71 mates with an internally threaded nut or bearing 72 mounted on cam ring 42 by bolts 73 and has a sprocket 74 mounted thereon in driving relation thereto. A sprocket chain 75 is trained about the multiple sprockets 74 for rotating the sprockets 74 and shaft 71 in unison to raise and lower the cam ring 42.

One of the shafts 71*a* (FIG. 5) extends through the cam ring 42 and into a transmission housing 76. A first bevel gear 77 is drivingly mounted on the upper end of shaft 71*a* in housing 76 and meshes with a second bevel gear 78 mounted on the output or drive shaft 79 of a reversible motor 80. The output of reversible motor 80 rotates shaft 71*a* and that rotation is transmitted to the sprocket chain 75 by the sprocket 74*a* thereon.

Figure 6:
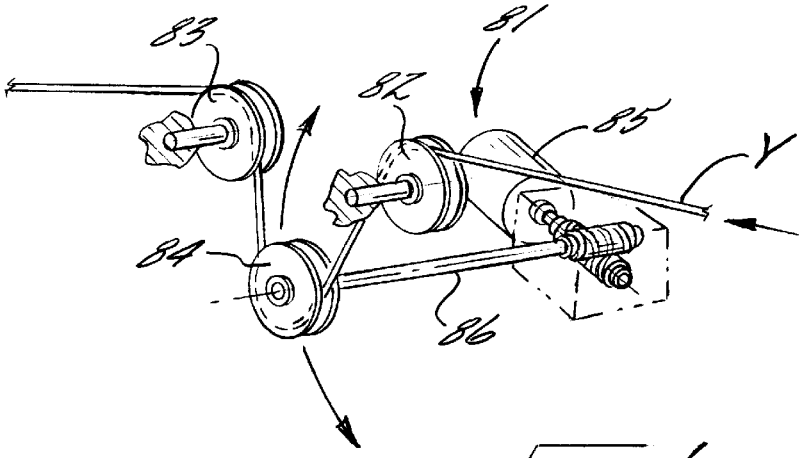
FIG. 6 is a fragmentary, somewhat schematic, perspective view of the tension sensor of the yam feeding device illustrated in FIG. 1.

A yarn tension sensor, generally indicated at 81 (FIGS. 1 and 6), is provided for monitoring the tension in yam Y and sending a tension data signal to a main control means or controller 150 (FIG. 1). Tension sensor 60 comprises first and second fixed pulleys 82 and 83 and a third movable pulley 84 between the first and second fixed pulleys 82 and 83. Movable pulley 84 is connected to a potentiometer 85 by a movable shaft 86. The movable pulley 84 moves up and down responsive to changes in the tension in yam Y and causes shaft 86 to rock. The rocking motion of shaft 86 is detected by the potentiometer 85, which generates a tension data signal delivered to the controller 150.

Figure 2:
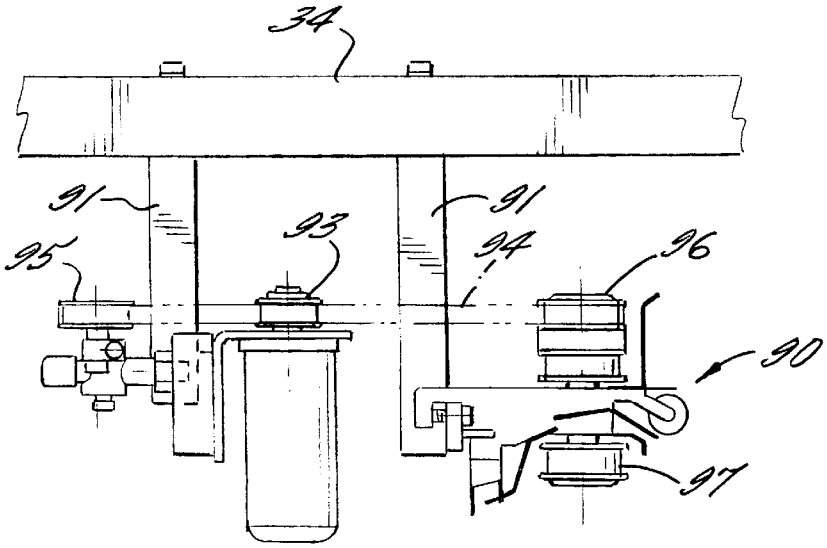
FIG. 2 is a fragmentary elevational view of the yam feeding device illustrated in the upper right portion of FIG. 1.
Figures 17, 18:
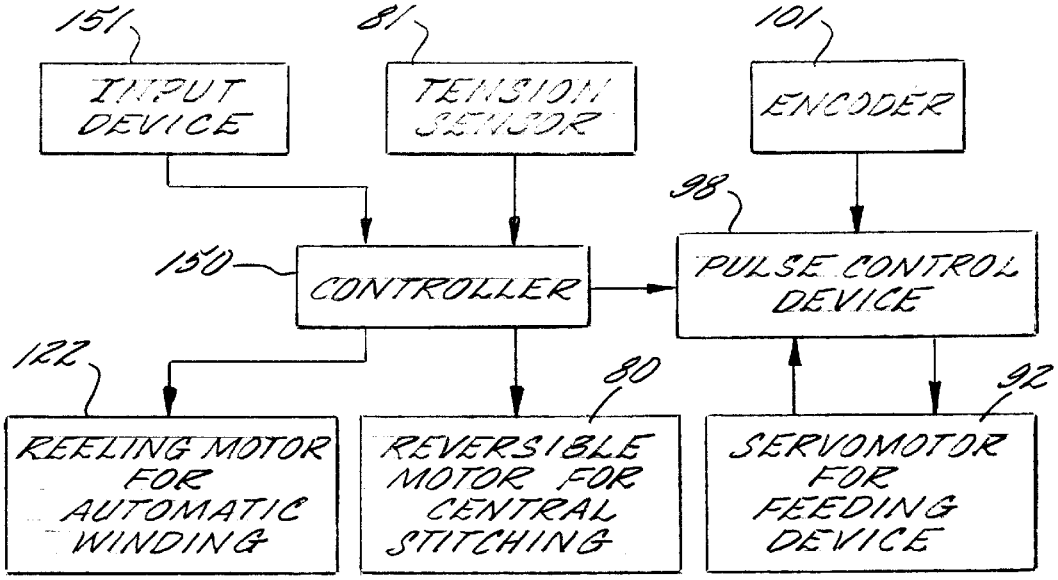
FIG. 17 is a block diagram of the control and drive systems of the present invention.
FIG. 18 is a table of fabric specifications obtained by a knitting machine.
Figure 19:
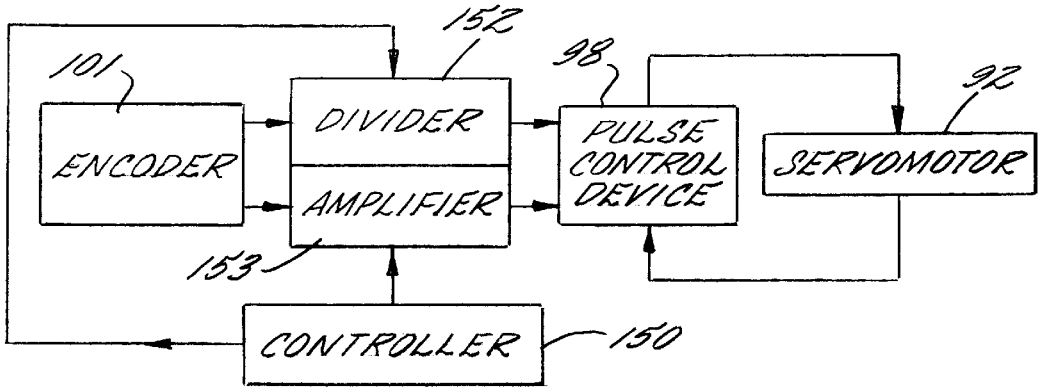
FIG. 19 is a block diagram of another embodiment of the control system of the present invention.
Figure 20:
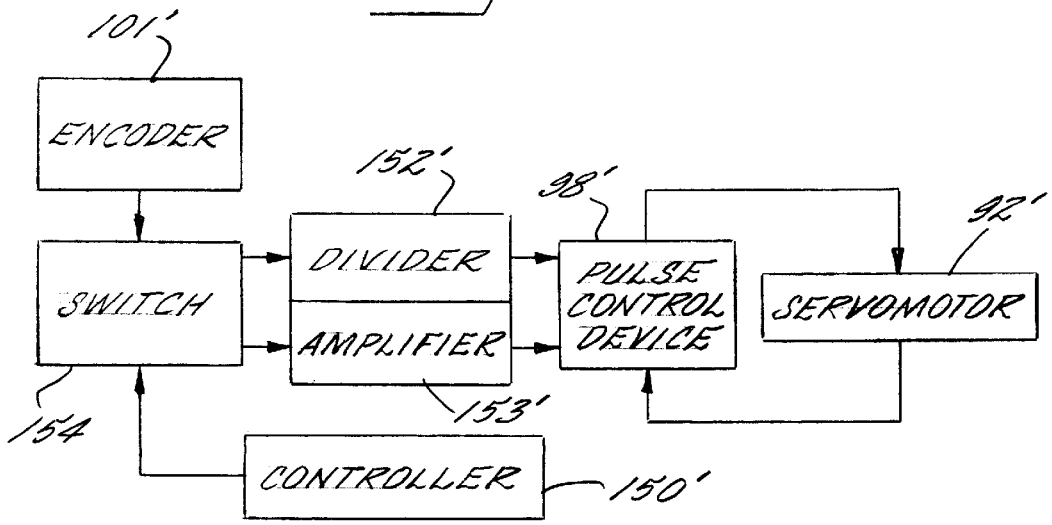
FIG. 20 is a block diagram of a further embodiment of the control system of the present invention.

The yarn Y is positively fed to the yarn carrier 54 by a yarn feeding device, generally indicated at 90 (FIGS. 1 and 2), suspended from the horizontal support members 34 by brackets 91. Yarn feeding device 90 includes a servo-motor 92 having a drive pulley 93 mounted on the output shaft thereof. A drive belt 94 is trained about drive pulley 93, an idler pulley 95 and a driven pulley 96. Pulley 96 is mounted on a shaft which mounts a yarn feed roll 97. Servo-motor 92 is provided with a pulse control device 98 (FIGS. 17, 19 and 20). Such a positive yarn feeding device 90 is available commercially, such as a MPF active yarn feed device manufactured by Memminger-IRO of Germany. The servo-motor 92 is preferably a low inertia type, such as MSM041A1G 400 w by Matsushita Electric. With this motor and yarn feeding device, yarn volume may be varied within the range of about 37.5 mm to 187.00 mm per revolution of a 30-inch circular knitting machine without a gear change. Because the drive pulley 92 is directly connected to the motor shaft, there is no need for a mechanical transmission device, such as gears. Accordingly, there will be no backlash between mechanical parts that may cause imperfections in the knit fabric.

Figure 3:
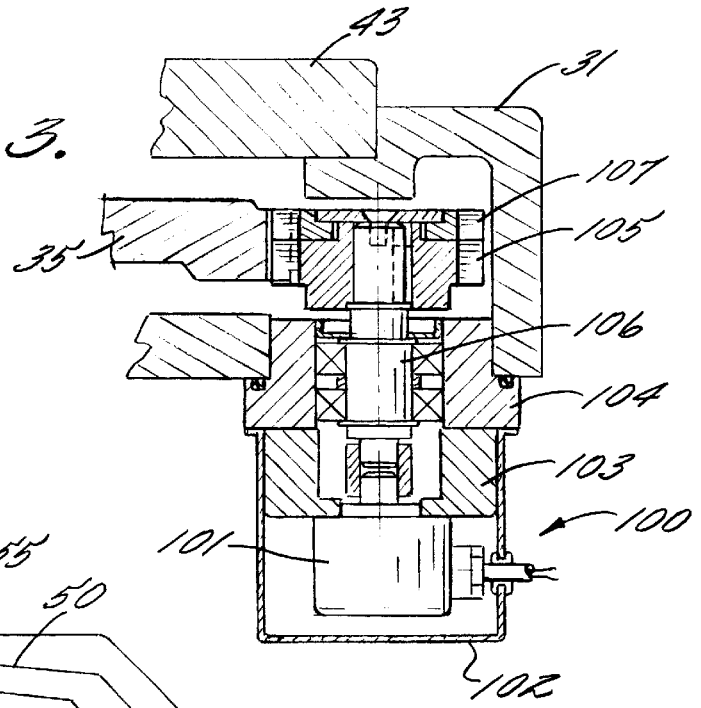
FIG. 3 is a sectional view taken substantially along line 3—3 in FIG. 1.

The fabric density adjusting system of the present invention includes a knitting machine rotary movement detecting means, generally indicated at 100 (FIG. 3). Detecting means 100 includes a rotary encoder 101 enclosed in a housing 102 and mounted on bed 31 by a mounting block 103 and bearing block 104. Encoder 101 is connected to the drive means for the knitting machine 30 which includes the ring gear 35 by a drive spur gear 105 meshing with the ring gear 35 and connected to encoder 101 by a shaft 106. Preferably, a backlash eliminating gear 107 is mounted on shaft 106 above drive gear 105.

Rotary encoder 101 is provided with an optical rotation-volume sensor for monitoring the rotational speed of the ring gear 35. Encoder 101 generates and transmits to the controller 150 a signal as a yarn volume data of the yam Y being fed to the needles 41. Such encoders are publicly known and commercially available.

Knitting machine 30 includes a knit fabric take-up or reeling device, generally indicated at 110 (FIGS. 1, 7A, 7B and 8). Reeling device 110 includes a take-up roll 111 about which the knit fabric is wound into a roll and three let-off rolls 112, 113 and 114. Take-up roll 111 and let-off rolls 112, 113 and 114 are mounted for rotation on a take-up frame, generally indicated at 115, which rotates with the ring gear 35 and includes depending support arms 116 and 117 connected at their lower ends by a connector 118. Connector 118 is mounted on a rotatable support 120 (FIGS. 1 and 9) carried by the base 121 of the knitting machine 30.

Figure 8:
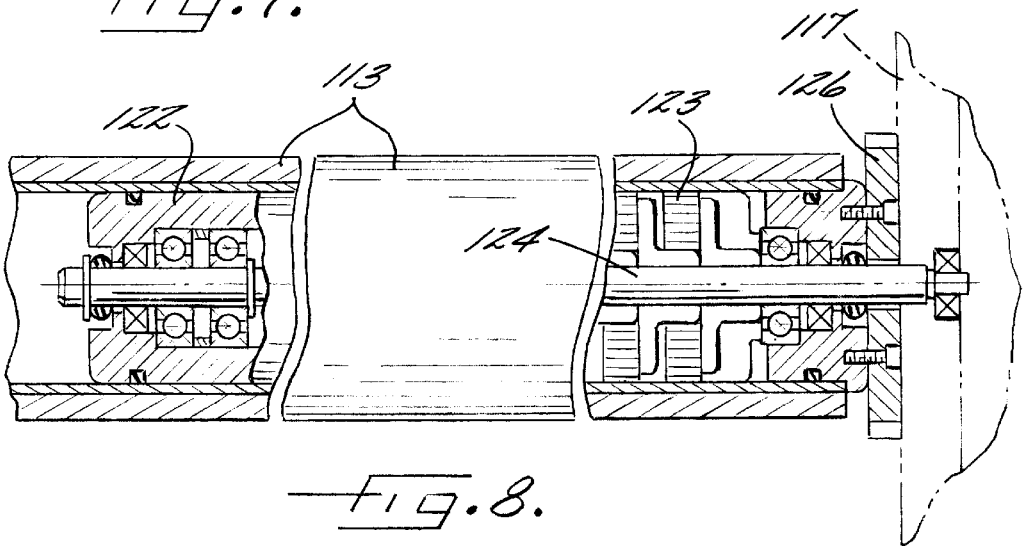
FIG. 8 is an enlarged, sectional view taken substantially along line 8—8 in FIG. 7.
Figure 9:
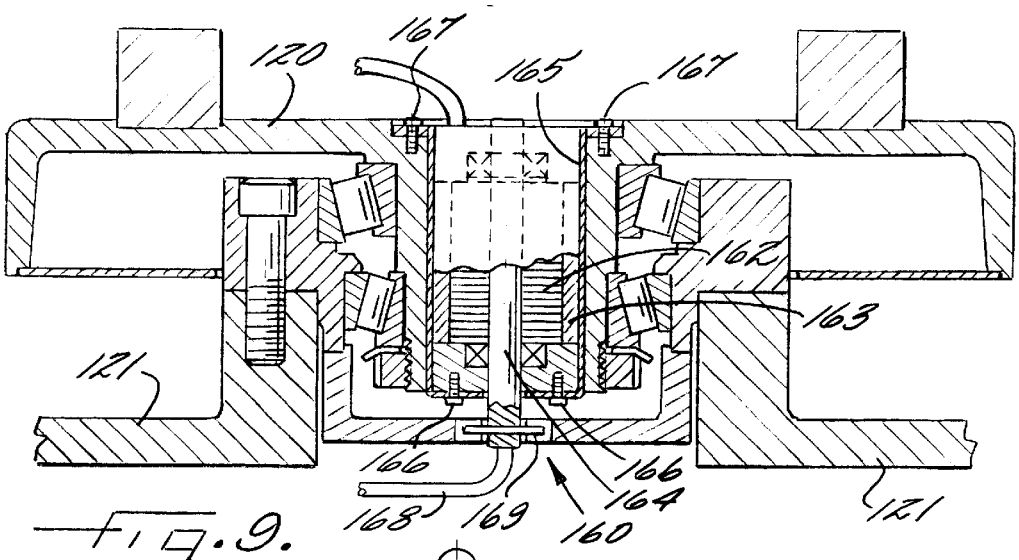
FIG. 9 is an enlarged sectional view taken substantially along line 9—9 in FIG. 1.

The let-off roll 113 is mounted at its opposite ends on support arms 116 and 117 and has a built-in out-rotor type DC motor 122 mounted therein (FIG. 8). An example of this type of motor 122 is currently manufactured by Ito Electric K.K. Motor 122 is mounted co-axially within let-off roll 113 and includes a reduction gear 123 mounted on an output shaft 124. Output shaft 124 is fastened to a bearing 125 in such a manner that the shaft 124 does not rotate, but the let-off roll 113 rotates with the motor 122 about the shaft 124. A spur gear 126 is mounted on the end face of let-off roll 113 adjacent the motor 122, but could be mounted on the opposite end of let-off roll 113. Also, the motor 122 could be installed in one of the other let-off rolls 112, 114, if desired.

A first swing arm 130 is pivotally mounted on support arm 116 by a pivot pin 131 and supports one end of let-off roll 112 for rotation and for movement toward and away from stationary let-off roll 113. A second swing arm 132 is pivotally mounted on support arm 116 by a pivot pin 133 and similarly mounts one end of let-off roll 114. Swing arms 130 and 132 are biased toward each other, which also biases let-off rolls 112 and 114 toward and against let-off roll 113, by a pair of springs 134, 135. Springs 134, 135 are fastened at one end to support arm 116 by a pin 136 and are adjustably connected at their opposite ends to swing arms 130, 132, respectively, by adjustment screws 137, 138.

A release cam 140 is mounted on a shaft 141 between the upper ends of swing arms 130 and 132 and shaft 141 has a manual lever arm 142 connected thereto. Lever arm 142 can be moved in a clockwise direction as seen in FIG. 7A to rotate release cam 140 and move the swing arms 130, 132 apart, which moves let-off rolls 112 and 114 away from let-off roll 113. Movement of lever arm 142 a first predetermined distance moves swing arm 130 away from swing arm 132 and further movement of lever arm 142 moves swing arm 132. A similar arrangement for mounting let-off rolls 112 and 114 is provided at the opposite ends thereof, but is not illustrated in the drawings and will not be specifically described.

Figure 7:
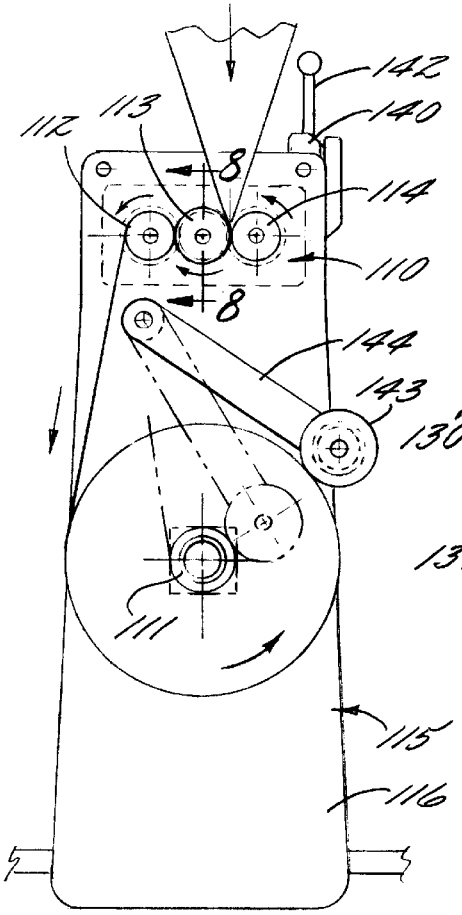
FIG. 7 is a fragmentary schematic view of the fabric reeling device shown in FIG. 1.
Figure 7A:
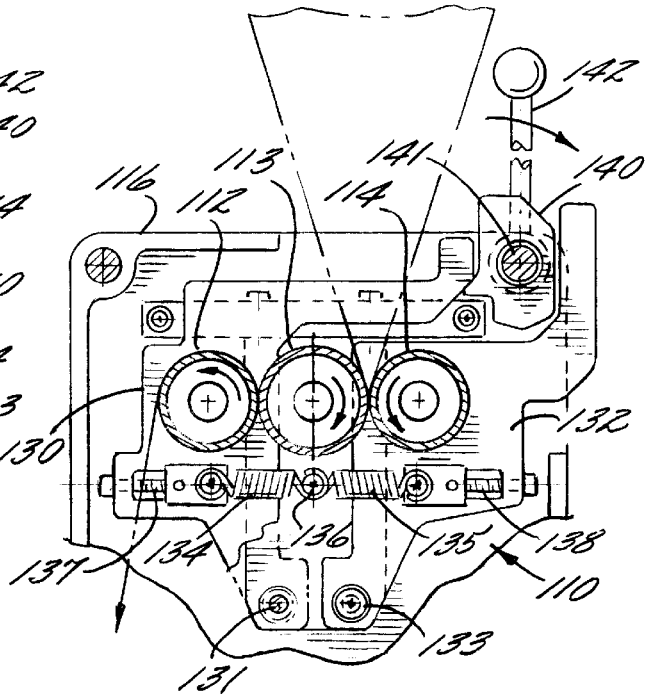
FIG. 7A is a fragmentary, sectional view of the upper portion of the fabric reeling device shown in FIG. 7.

A pressure and driving roller 143 is mounted at its opposite ends on swingable support arms 144 pivotally mounted on side support arms 116 and 117 for engagement with the take-up roll 111 and the outer surface of the fabric roll being wound around takeup roll 111 (FIG. 7). Similar to let-off roll 113, driving roller 143 is preferably equipped with an out-rotor type DC motor (not shown) similar to motor 122. Alternatively, driving roller 143 may be driven by way of a chain and sprocket arrangement (not shown) from let-off roll 113.

Figure 10:
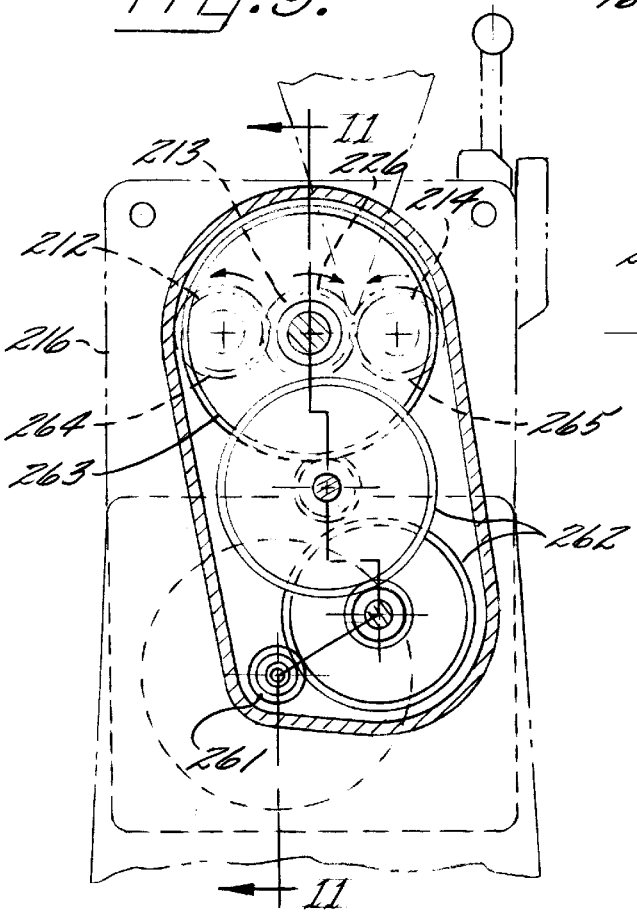
FIG. 10 is a sectional view of the power transmission mechanism of another embodiment of the automatic reeling device of the present invention taken substantially along line 10—10 in FIG. 11.
Figure 11:
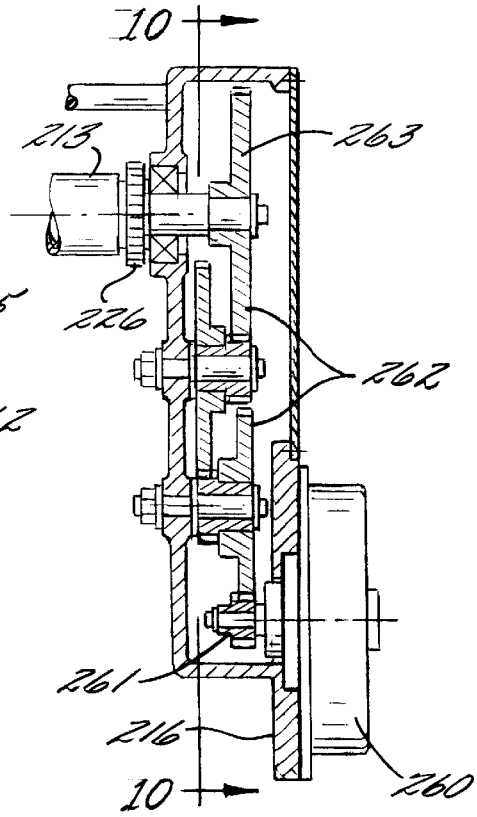
FIG. 11 is a section view taken substantially along line 11—11 in FIG. 10.
Figure 12:
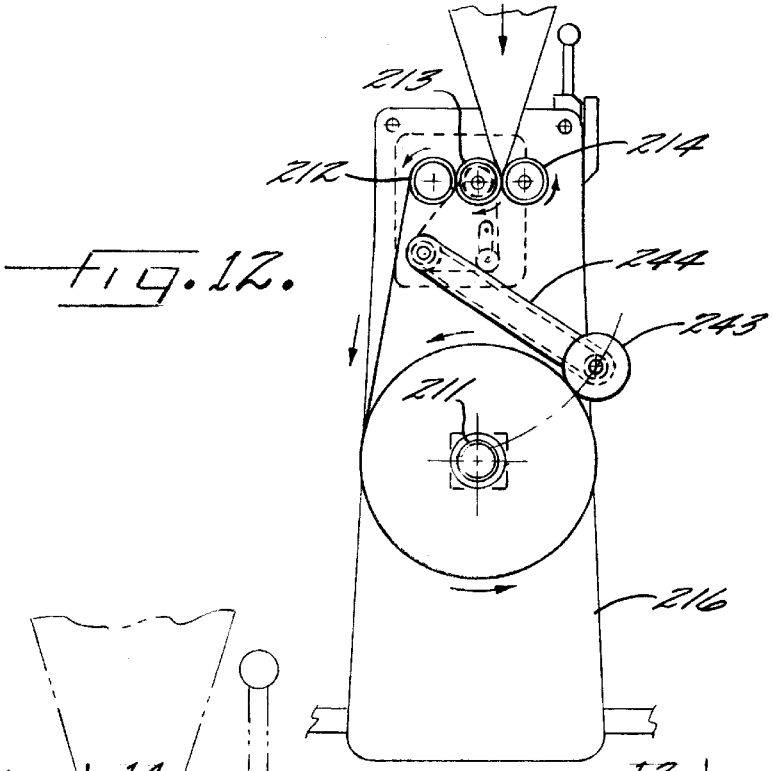
FIG. 12 is a fragmentary schematic diagram showing a side view of the fabric-reeling device illustrated in FIG. 10.
Figure 13:
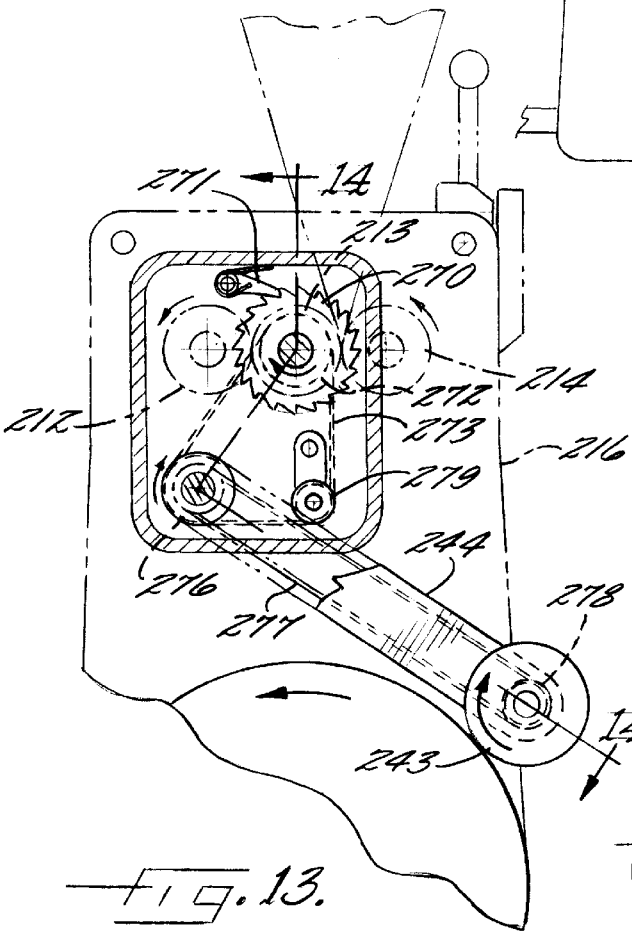
FIG. 13 is a fragmentary sectional view of the power transmission mechanism in the upper portion of FIG. 12.
Figure 14:
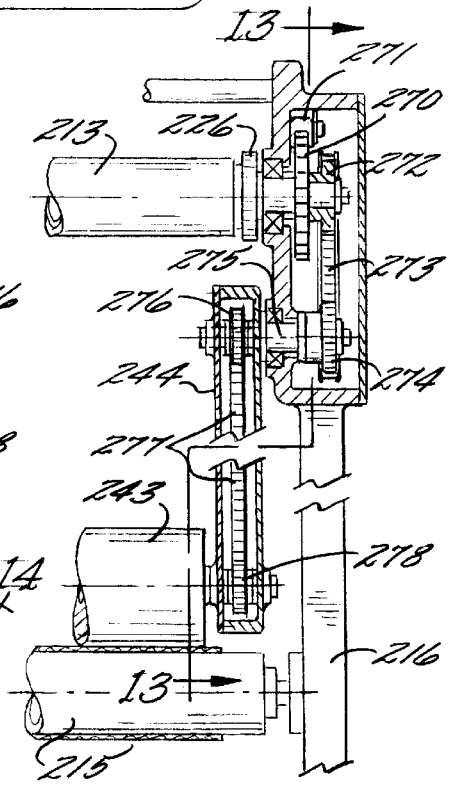
FIG. 14 is a sectional view taken substantially along line 14—14 in FIG. 13.

Referring now to FIGS. 10–14, another embodiment of an automatic take-up or reeling system, generally indicated at 210, is illustrated and similar reference characters with the first digit changed to "2" are used. Reeling system 210 is mounted on frame 215 and includes a motor 260 mounted on side support arm 216 and has a drive gear 261 on its output shaft which meshes by way of an intermediate gear train 262 with a spur gear 263 mounted on a let-off roll 213. Another spur gear 226 on roll 213 meshes with spur gears 264, 265 mounted on the shafts of let-off rolls 212 and 214, respectively (FIG. 10).

For imparting rotation to a driving roller 243 pivotally mounted on side support arm 216 by a swingable support arm 244, a ratchet wheel 270 is mounted on the outer end of the shaft of let-off roll 213 and has a ratchet claw 271 to prevent reverse rotation. A sprocket wheel 272 is fastened to ratchet wheel 270 for rotation therewith. A chain 273 is trained about sprocket wheel 272 and about a sprocket wheel 274 on a stub shaft 275, which also serves to pivotally mount swingable support arm 244. Another sprocket wheel 276 is also mounted on stub shaft 275 and drives a sprocket chain 277 which, in turn, drives a sprocket wheel 278 mounted on drive roller 243. A tension adjuster 279 is provided to adjust the tension or slack in chain 273.

Figure 15:
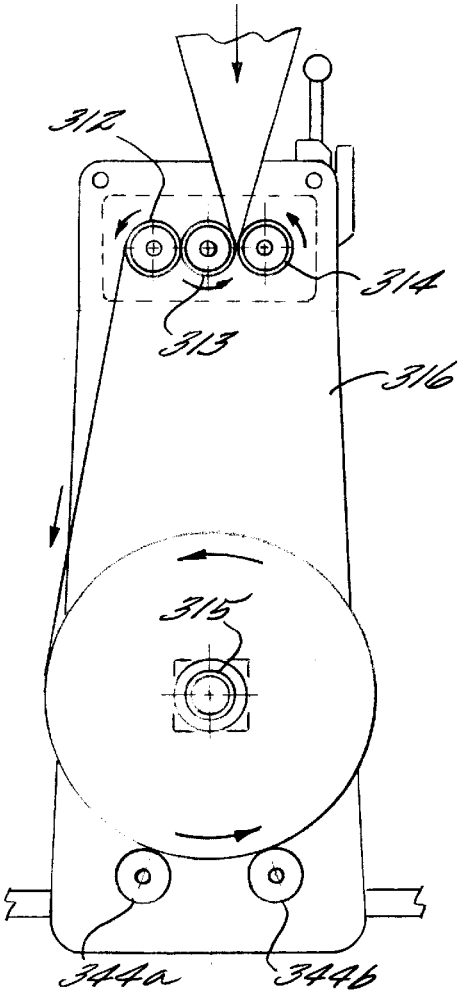
FIG. 15 is a schematic diagram showing a side view of a further embodiment of the fabric reeling device of the present invention.
Figure 16:
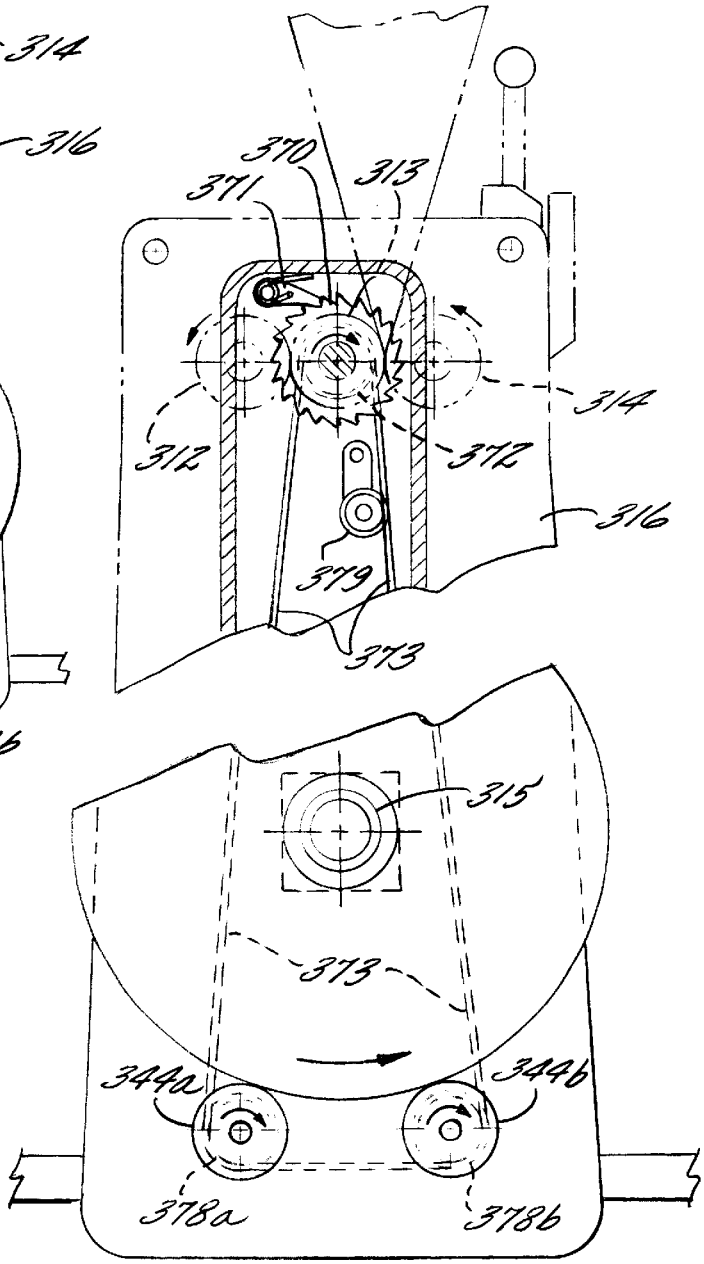
FIG. 16 is a fragmentary view, partially in section, of the power transmission mechanism shown in FIG. 15.

FIGS. 15 and 16 illustrate a further embodiment of a fabric reeling system 310 of the present invention. In this embodiment, a take-up roll 311 is a floating roll and has two drive rolls 344*a* and 344*b* below the take-up roll 311. A drive system for these drive rolls 344*a* and 344*b* includes a ratchet wheel 370 mounted on the shaft of let-off roll 313 with a ratchet claw 371 to prevent reverse rotation. A sprocket 372 is mounted on ratchet wheel 370 and drives a sprocket chain 373, which in turn derives sprockets 378*a* and 378*b* mounted on rolls 344*a* and 344*b*. A tension adjuster 379 maintains proper tension in chain 373.

An electrical feeder device, generally indicated at 160 (FIGS. 1 and 9) supplies electricity to the motors 122 and 260 of the reeling systems of the present invention. Feeder device 160 includes a bearing housing 161 mounted on base 121 and a contact ring 162 (which is a rotor), a carbon brush 163 (which is a fixed terminal), and a vertical shaft 164, all housed within a tubular box 165 and fastened therein by bolts 166. Tubular box 165 is fastened by bolts 167 to rotatable support 120 for the reeling system 110. A wire 168 passes through vertical shaft 164 and a roll pin 169 is inserted near the bottom of the shaft 164. Pin 169 meshes with a long hole 170 in the bearing housing 161 so that shaft 164 does not rotate. Thus, the reeling system, etc., of the knitting machine can rotate and the feeder device 160 supplies electricity thereto. The feeder device 160 does not necessarily have to be a carbon brush type; a mercury type also available commercially may be used.

When the texture of the fabric, such as the type and size of the yarn or number of stitches is changed, the production volume per revolution of the knitting machine is changed. At that time, if the reeling or take-up rate is constant, the fabric tension changes. For example, if the number of stitches is reduced, the production volume per revolution increases and, if the take-up rate remains constant, the fabric tension is reduced and the fabric slackens before it reaches the let-off rolls 112, 113 and 114. Accordingly, the take-up rate or reeling volume needs to be adjusted automatically according to the production volume per revolution of the knitting machine.

In accordance with the present invention, a desired take-up or reeling tension is set in the controller 150 according to the knit texture of the fabric, yarn, number of stitches, etc. This reeling tension entered in the controller 150 is converted to amperage by the conversion database, and the reeling drive motor or motors are operated using this amperage. In the embodiments hereof utilizing a DC motor as the reeling drive motor, the amperage is variable within the range of 0–5 amps.

It is known that when a constant electric current is supplied to a DC motor, the output torque of that motor is constant. When the production volume of the fabric changes, the motor rpm increases or decreases according to the variation. At this time, the amperage of the electric current supplied to the DC motor is different from the target amperage for that motor as determined by the conversion database from the desired fabric tension.

In order to solve this problem, the reeling control device in controller 150 continually checks if that amperage is the same as the previously set amperage, and controls the output so that the previously set amperage is obtained. In this way, the rotation torque of the reeling drive motor is always kept constant. In other words, even if the production volume is changed, the tension is always adjusted to the desired reeling tension automatically.

With a normal fabric reeling volume in a knitting machine, the above-described control device maintains the fabric tension at a constant level. However, for a larger fabric roll, the reeling torque changes according to the variations in the size and weight of the fabric roll, and this affects the reeling tension. Preferably, a potentiometer or a load cell (not shown) is provided to detect the size and weight of the fabric roll, and the amperage supplied to the reeling motor is corrected by the control device accordingly.

The operation of knitting machine 30 in accordance with the present invention and with reference to FIGS. 17–22 will now be described. As stated previously, all of the various parameters of the fabric patterns to be knit have been stored in the controller 150 and the knitting machine 30 is started and commences to knit fabric.

The controller 150 receives signals from each sensor 81 and 101 and from an input device 151 which is a means for loading into the controller 150 various conditions and settings about the knitting machine and other variable parameters, examples of which are a keyboard, mouse or reader. Examples of the type of data provided by such an input device 151 would be the total number of cylinder needles 41 and the yarn volume to be set. In addition to, or instead of the information from the input device 151, information can be input using ID codes. Such ID codes can be various two-dimensional codes, bar codes, etc. Various fabric-knitting conditions are retrieved from the knitting machine as digital data and codified. For example, the information contained in the fabric table of FIG. 18 is retrieved and two dimensionally codified and printed. Then, the ID code is read by an image scanner and data are known. See, for example, the technique disclosed in JPA-9-171536 (1997).

Compared with the keyboard-input method, the ID-code input method has the following advantages.

1. To knit a certain fabric, the operator can adjust the knitting machine, decide the best knitting conditions, and print out the data for future use. The storage medium is usually paper, which is easy to obtain and cheap. Printing on a card size medium makes it easy to carry too.

2. By reading the printed ID code using the image scanner, which comes together with the knitting machine, the date can be set instantaneously.

3. Even a relatively inexperienced knitting operator can set the data easily without any mistakes.

4. The ID-codified information can be input or output using a personal computer other than the one that comes along with the knitting machine. Accordingly, the fabric information can be made, edited and saved remotely, and printed out for manual input to the knitting machine.

With the foregoing input data and sensor signals, the controller 15 compares this information to the previously set data and transmits a corrective signal or signals to the reeling motor 122, the reversible motor for central stitching 80 and the pulse control device 98 for the servo-motor 92 for the yam feeding device 90 (FIG. 17).

Referring now to FIG. 19, there is illustrated a block diagram showing a first embodiment of a divider-amplifier. The encoder pulse from the rotary encoder 101 is transmitted to a divider 152 and an amplifier 153. Based on the input data from the input device 151, the general control device 150 determines the scale factor of the encoder 101 and the servomotor 92 for the yarn feeding device 90. If the scale factor is 1 or smaller, it is sent to the divider 152; if it is larger than 1, it is sent to the amplifier 153. After receiving the scale factor, the divider 152 or the amplifier 152 amplifies or de-amplifies the encoder pulse and transmit to the pulse control device 98. The amplified or de-amplified encoder pulse sent to the pulse control device 98 is compared with the feedback pulses from the servo motor 92 for the yam feeding device 90, and the appropriate pulse is sent to the servo motor 92 for the yarn feeding device 90 so that the difference between the amplified and de-amplified encoder pulse and the feedback pulse is zero.

Referring now to FIG. 20, there is illustrated a block diagram showing a second embodiment of a divider-amplifier 152'–153'. The encoder pulse from the rotary encoder 101 is transmitted to the divider/amplifier switcher 154. Based on the input data from the input device 151', the general control device 150' determines the scale factor of the encoder 101' and the servomotor 92' for the yarn feeding device 90' and sends the sale factor to the divider/amplifier switcher 154. After receiving the encoder pulse and the scale factor, the divider/amplifier switcher 154 transmits the encoder pulse and the scale factor to either the divider 152' or the amplifier 153' according to the scale factor. It is preferable to use a divider-amplifier having dividing, amplifying and switching functions.

On the basis of the input yarn volume and the values measured by the tension sensor 81, the general control device 150' determines the rotation conditions for the reversible motor 80 for the central stitching, and sends them to the reversible motor 80. At the same time, the general control device 150' determines the rotation conditions of the automatic reeling motor 122 on the basis of the input yam volume, and sends them to the reeling motor 122.

Figure 21A:
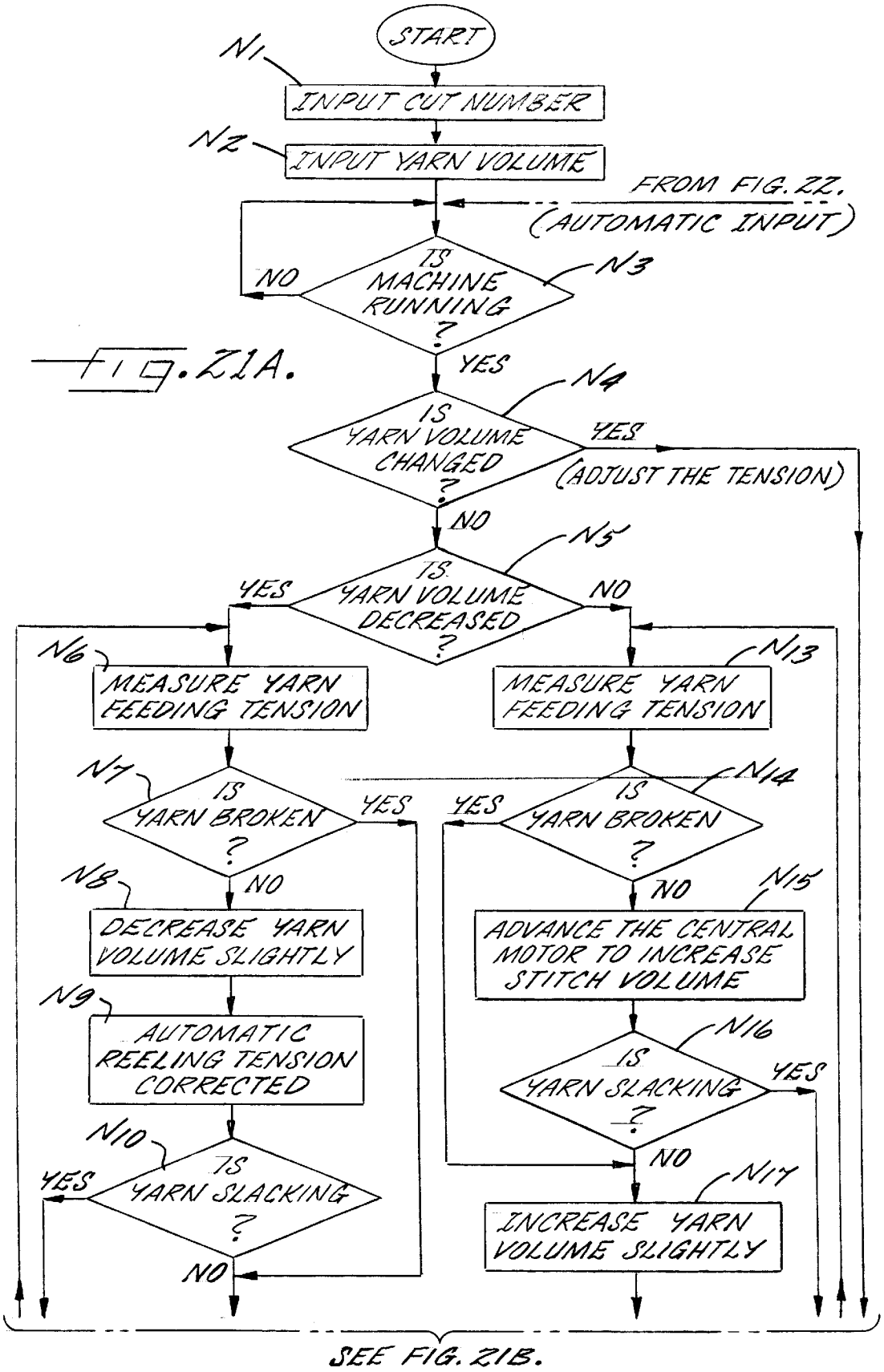
FIG. 21A is a flow chart of a portion of the operations of the device according to the present invention.
Figure 21B:
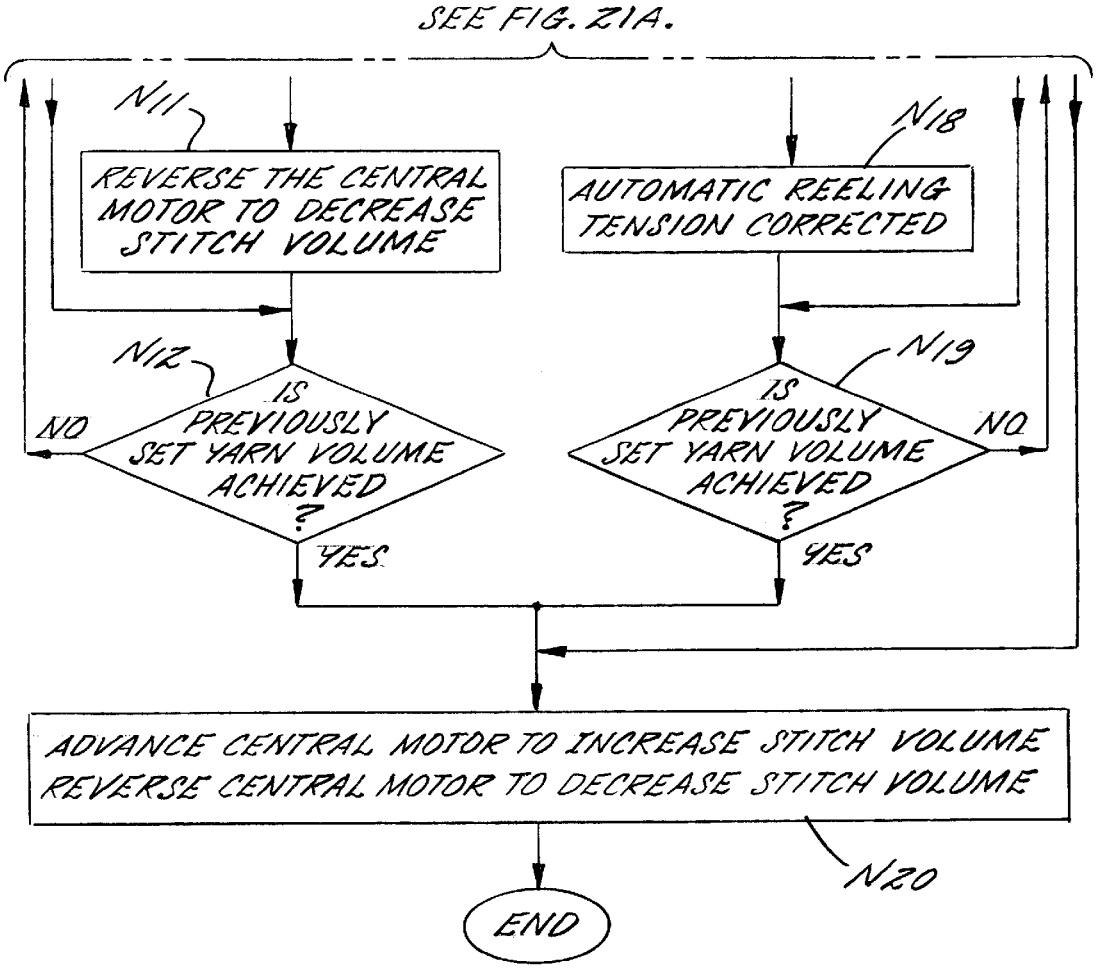
FIG. 21B is a continuation of a flow chart shown in FIG. 21A.
Figure 22:
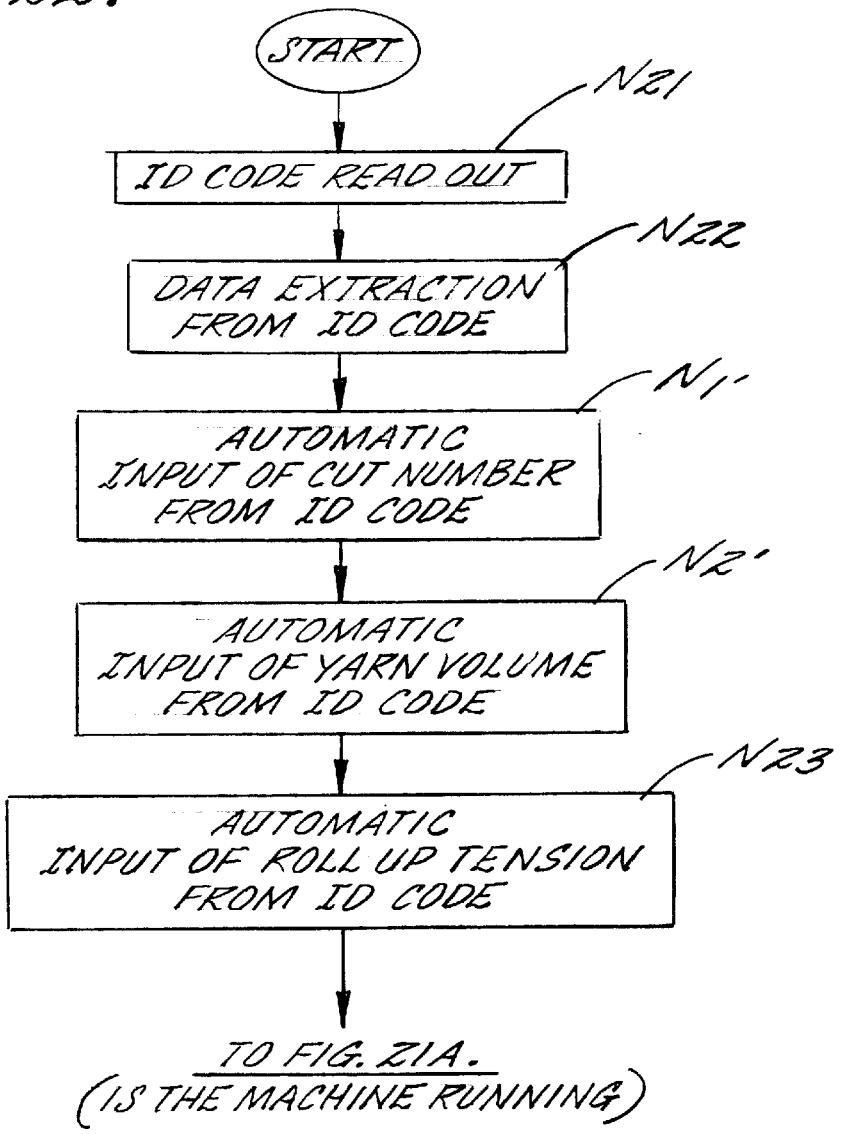
FIG. 22 is a flow chart of preferred initial operations preceding the steps shown in FIGS. 21A and 21B.

The step-by-step operations of the automatic control according to the present invention will now be described by reference to the flow chart of FIGS. 21A and 21B. In these FIGS., N1 to N17 respectively correspond to each step of the automatic control.

Step N1: Input the number of cuts (total number of cylinder needles) by input device 151.

Step N2: Enter the previously set yarn volume by input device 151, and start the system.

Step N3: Confirm that the system is running.

Step N4: If the yam volume coincides with the previously input yam volume, just adjust the tension.

Step N5: If the yam volume does not coincide with the previously input yam volume, judge whether the yam volume has decreased or increased.

Step N6: If the yarn volume had decreased at step N5, measure the yam-feeding tension at this step.

Step N7: As a result of the measurement, if there is a possibility of a yam breakage, go to step N11 (FIG. 21B).

Step N8: If there is no possibility of a yarn breakage, decrease the yam volume slightly.

Step N9: The automatic reeling mechanism automatically corrects the reeling tension that has been changed.

Step N10: If there is a possibility of the yarn slackening, go to N12 (FIG. 21B). Otherwise, go to N11 FIG. 21B).

Step N11: Reverse the reversible motor 80 for central stitching slightly to decrease the central stitch volume.

Step N12: Judge whether the previously set yarn volume has been achieved. If not, go back to N6.

Step N13: If the yarn volume had increased at step N5, measure the yarn-feeding tension at this step.

Step N14: As a result of the measurement, if there is a possibility of a yarn breakage, go to N17.

Step N15: If there is no possibility of a yarn breakage, advance the reversible motor 80 for central stitching slightly to increase the stitch volume.

Step N16: If there is a possibility of the yarn slackening, go to N19.

Step N17: If there is no possibility of the yarn slackening, increase the yam volume slightly.

Step N18: The automatic reeling mechanism automatically corrects the reeling tension that has been changed.

Step N19: Judge whether the previously set yarn volume has been achieved. If not, go back to N13.

Step N20: N5 and N19 are the steps at which the stitch volume of the knitting machine is changed according to the change in the yarn volume. At step N20, the yarn feeding tension is set more precisely. If the previously set yarn volume had been achieved at N12 or N19, measure the yarn feeding tension, and in order to set the desired tension, slightly advance or reverse the reversible motor 80 for central stitching so as to increase or decrease the stitch volume.

As mentioned earlier, the input/output data can be CD-codified. In that case, before beginning the steps in the flow chart of FIG. 22, an ID-code read-out step N21 and data take-out step N22 are added as shown in FIG. 21A between steps N2 and N3. The next three steps N1', N2' and N23 are in place of steps N1 and N2 as discussed in regard to FIG. 21A above.

According to the present invention, no special skill is needed to automatically adjust the fabric density of a complex knitting machine 30 that has many yarn feeders. Therefore, the present invention can be effectively employed in small lot production. By automatically adjusting the yam-feeding volume, stitch volume and reeling volume to the appropriate level based on the data obtained by the setting means or various measuring means, high quality fabrics can be obtained.

The present invention is also effective in re-knitting previously knit fabrics without any special skill.

Even in the cases in which various parts of the knitting machine expand because of the heat generated during the operation of the knitting machine, changing the yarn feeding tension and affecting the quality of the fabric, the present invention makes it possible to obtain high-quality fabrics by automatically adjusting the stitch volume to the appropriate level based on the data obtained by various measuring means or sensors.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. In a circular knitting machine including a rotatable needle cylinder having needle grooves therein, a knitting needle slidably mounted in each needle groove in said cylinder, a cam holder facing said cylinder, needle operating cams carried by said cam holder and having cam tracks engageable by butts on said needles for moving said needles between their various positions, and a positive yam feeding device for feeding yarn to said knitting needles, in combination therewith an automatic yarn feeding control system including means for detecting rotary movement of said needle cylinder and for generating a signal relative thereto, and means for driving said positive yam feeding device responsive to the signal from said detecting means.

2. A circular knitting machine according to claim 1 wherein said driving means includes a servo-motor.

3. A circular knitting machine according to claim 1 wherein said detecting means includes a rotary encoder.

4. A circular knitting machine according to claim 3 wherein said means for driving said yarn feeding device includes a servo-motor.

5. A circular knitting machine according to claim 4 wherein pulse control means is connected to said encoder and said servo-motor for comparing the signal from said encoder with a feed-back signal from said servo-motor and controlling said servo-motor so that the difference between those signals is zero.

6. A circular knitting machine according to claim 5 including a divider for dividing the signal from said encoder and an amplifier for amplifying the signal from said encoder.

7. A circular knitting machine according to claim 6 including switch means for using selectively either the divided signal or the amplified signal from said encoder depending on the driving condition of said servo-motor for causing said pulse control means to output a control signal to said servo-motor.

8. An automatic fabric density adjusting system for a knitting machine comprising means for setting a base yarn volume required for a predetermined knit fabric, a positive yarn feeding device for feeding yarn to the knitting machine, an automatic yam feeding control system for operating said positive yarn feeding device to feed yarn to the knitting machine based upon the yarn volume required for the fabric being knit adjusted for the sensed rotation of the knitting machine, means for detecting tension in the yarn being fed by said yarn feeding device, and means for adjusting stitch volume of the knitting machine in accordance with variations of the detected yarn tension.

9. An automatic fabric density adjusting system according to claim 8 including means for setting a base production volume of the fabric being knitted, and automatic reeling means for taking-up the knit fabric at a rate adjusted in accordance with the set production volume of the fabric.

10. A fabric density adjusting system according to claim 9 including means for detecting tension in the fabric being taken-up by said reeling means, and means for adjusting said reeling means in accordance with detected variations in fabric tension.

11. A fabric density adjusting system according to claim 8 or claim 9 wherein said means for setting a base fabric production volume is an ID code.

12. A fabric density adjusting system according to claim 11 wherein said ID code is a two-dimensional code.

* * * * *

UNITED STATES PATENT AND TRADEMARK OFFICE

CERTIFICATE OF CORRECTION

PATENT NO. : 6,301,938 B1
DATED : October 16, 2001
INVENTOR(S) : Takeuchi et al.

It is certified that error appears in the above-identified patent and that said Letters Patent is hereby corrected as shown below:

Title page,
Item [56], References Cited, FOREIGN PATENT DOCUMENTS,
Line 7, "8/1986" should read -- 10/1985 --.

Column 9,
Line 62, "yam" should read -- yarn --.

Column 10,
Lines 3 and 35, "yam" should read -- yarn --.

Signed and Sealed this

Tenth Day of September, 2002

*Attest:*

*Attesting Officer*

JAMES E. ROGAN
*Director of the United States Patent and Trademark Office*